United States Patent [19]

Tajima et al.

[11] 4,219,995

[45] Sep. 2, 1980

[54] WIRE ROPE

[75] Inventors: Shinobu Tajima; Kazutoshi Ohta, both of Inazawa, Japan

[73] Assignee: Mitsubishi Denki Kabushiki Kaisha, Tokyo, Japan

[21] Appl. No.: 940,242

[22] Filed: Sep. 7, 1978

[30] Foreign Application Priority Data

Sep. 7, 1977 [JP] Japan ..... 52/107551

[51] Int. Cl.[3] ..... D07B 1/06

[52] U.S. Cl. ..... 57/220; 57/213; 57/216

[58] Field of Search ..... 57/200, 210, 211, 213, 57/214, 216–218, 220, 222, 223, 230, 902; 140/149

[56] References Cited

U.S. PATENT DOCUMENTS

| | | | |
|---|---|---|---|
| 1,099,644 | 6/1914 | Gore | 57/213 |
| 3,104,515 | 9/1963 | Stevens | 57/220 |
| 3,511,622 | 5/1970 | Nation | 57/212 X |
| 3,822,542 | 7/1974 | Naud et al. | 57/215 |
| 3,977,174 | 8/1976 | Boileau | 57/216 X |
| 4,051,661 | 10/1977 | Leprohon et al. | 57/214 |

*Primary Examiner*—Donald Watkins

*Attorney, Agent, or Firm*—Sughrue, Rothwell, Mion, Zinn & Macpeak

[57] ABSTRACT

A wire rope is formed by twisting two different metal wires which vary from each other by at least 50% in their loss factors. The two different metal wires are combined in two embodiments: first, wires of steel material and wires of titanium containing material, or secondly, wires of a steel material and wires of chromium stainless steel material. In a preferred embodiment, a wire rope is formed by twisting a plurality of strands around a center core and two different metal wires as described above are employed to form the strands.

8 Claims, 12 Drawing Figures

WIRE ROPE

BACKGROUND OF THE INVENTION

This invention relates to wire ropes which are generally employed as travelling cables of elevators.

To aid in a full understanding of this invention, first, a known winding for wire rope will be described with reference to FIG. 1.

FIG. 1 shows a cross-sectional view of a construction for stranding wire rope, comprising; a fiber center core 1 made of a non-metallic material such as hemp or the like and a plurality of strands 2 which are twisted around the center core 1. Each of the strands 2 is made up of: a metal center wire 3 which is made of steel material and constitutes a part of wires forming the strand 2, a plurality of inner layer wires 4 of steel material which are laid around the metal center wire 3 and constitute a part of the wires, and a plurality of outer layer wires 5 of steel material which are laid around the inner layer wires 4 and constitute a part of the wires. The metal center core 3, the inner layer wires 4 and the outer layer wires 5 are made of the same steel material.

This wire rope when formed using conventional materials as set forth in accordance with FIG. 1 is unsatisfactory in terms of performance when it is subject to vibration. Its vibration damping effect is insufficient and a harmful resonance phenomenon takes place.

In an elevator with a hoisting unit having an induction motor, the speed is controlled by a thyristor circuit. In such a system, a high frequency vibration two to six times the power frequency takes place because of vibration induced by torque ripple of the motor accompanying the thyristor speed control. This vibration is transmitted through the travelling cables of the elevator to the cage thereof, which causes an uneasy motion in the ride and tends to irritate the passengers. More specifically, when the high frequency vibration is transmitted to the wire rope, a surging of the rope (hereinafter referred to as "rope surging" when applicable) occurs in association with the natural frequency of longitudinal vibration of the wire rope because the wire rope is a continuous unit, thereby resulting in the vibration of the cage. In addition, the magnitude of the noise level in the cage is increased by this rope surging. Hence, the conventional wire rope has a variety of unfavorable characteristics as described above.

SUMMARY OF THE INVENTION

A primary object of the present invention is to eliminate the above described drawbacks of the conventional wire rope.

Another object of the present invention is to provide a wire rope, having a vibration damping effect which is sufficient to positively eliminate the undesired harmful resonance phenomenon.

The foregoing objects are achieved by the provision of wire rope which is formed by twisting two different metal wires which are different from each other by at least 50% in their loss factors. The combination of the two different metal wires are steel wires and wires of titanium containing material or steel wires and chromium stainless steel wires. The invention will be described in detail with reference to the foregoing description of the Preferred Embodiment and Drawings.

DETAILED DESCRIPTION OF THE PREFERRED EMBODIMENTS

Figure 1:
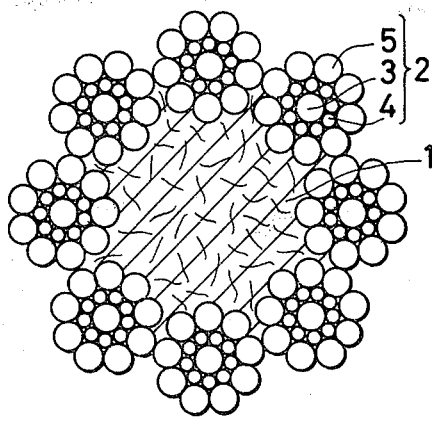
FIG. 1 is a cross-sectional view of a first type of stranding for wire rope using the teachings of this invention.

One preferred embodiment of the present invention will be described with reference to FIGS. 1 through 4. It should be noted that corresponding parts in FIGS. 1 through 4 have the same identifying reference numerals.

Referring to FIG. 1, a wire rope according to the present invention is shown. It comprises: a fiber center core 1 made of a non-metallic material such as hemp or the like and a plurality of strands 2 laid around the fiber center core 1. Each of the strands 2 comprises a center wire 3 constituting a part of wire forming the stand; a plurality of inner layer wires 4 laid around the center wire 3 constituting a part of the wire; and a plurality of outer layer wires 5 laid around the inner layer wires 4 also constituting a part of the wire. This type of rope has been classified according to JIS G 3525 (1977) as "Type 15".

The center wire 3 is a class 2 wire made of chromium stainless steel, e.g., 13Cr type stainless steel belonging to martensitic stainless steel, which is defined by SUS 410 in JIS (Japanese Industrial Standard) and has a chemical composition of Cr 13% and Si 1%, while the inner and outer layer wires 4 and 5 are class 1 wires made of ordinary steel material.

Figure 2:
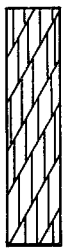
FIGS. 2 and 3 are explanatory diagram showing a first example of a wire rope made according to the present invention.
Figure 3:
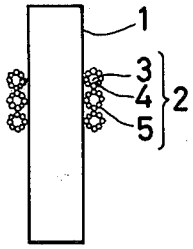

As is apparent from FIG. 2 showing the appearance of the wire rope and FIG. 3 showing a longitudinal sectional view thereof, the strands 2 are laid twisted around the fiber center core 1, and each of the strands 2 has the inner layer wires 4 and the outer layer wires 5 which are twisted around the center wire 3 in such a manner that they are in contact with one another.

Thus, the wire rope according to the present invention is similar in construction to a conventional rope but uses different materials assembled in a particular manner. However, it should be noted that, in this embodiment, the vibration damping factor in a solid substance (hereinafter referred to "loss factor" when applicable) of the class 2 wire constituting the center wire 3 is equal to or more than 0.01, and the loss factor of the class 1 wires constituting the inner layer wires 4 and the outer layer wires 5 is of the order of 0.001 to 0.002.

Dynamic Young's modulus [E] of the material can be represented by the following well known expression:

$$E=E_O(1+j\omega\eta)$$

where:
$E_O$=static Young's modulus of the material;
$\omega$=angular frequency;
j=imaginary unit; and
$\eta$=loss factor.

A method of actually measuring the loss factor will be described with reference to FIGS. 4 and 5.

Figure 4:
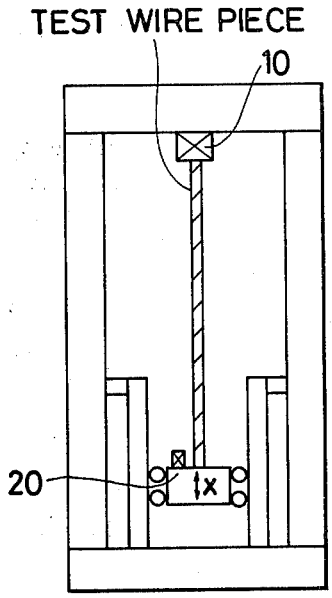
FIG. 4 shows a schematic diagram of measuring apparatus for measuring loss factors.

In FIG. 4 which shows a schematic diagram of measuring apparatus, the upper end of the test wire piece to be measured is fixedly secured to the stationary portion of the measuring apparatus and the force F where $F=F_0 \sin \omega t$ is applied to the upper portion of the test wire piece by an exciter 10. The vibration is transmitted to the lower portion of the test wire piece, and it is picked-up as $X=X_0 \sin (\omega t+\phi)$ by a response pick-up 20.

Figure 5:
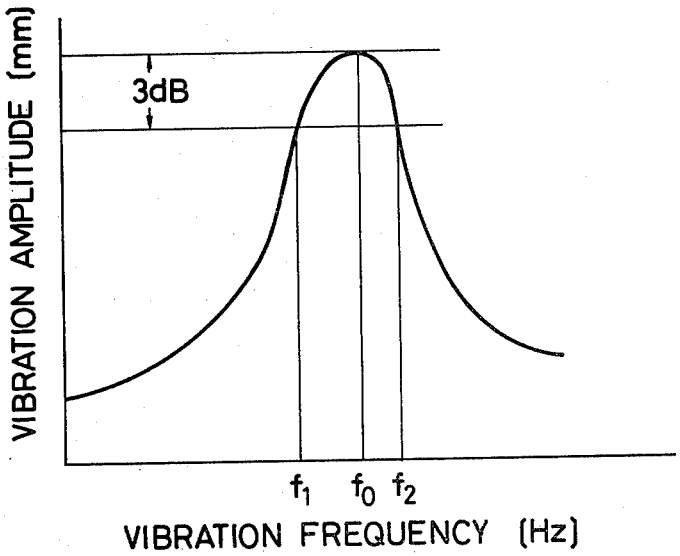
FIG. 5 is a graphical representation indicating the relation between vibration frequency vs vibration amplitude.

FIG. 5 shows plots of the vibration frequency applied to the upper portion of the test wire piece with the vibration amplitude in mm/sec$^2$ on vertical axis and the vibration frequency in Hz on the horizontal axis. In this case, the frequency value corresponding to the peak value of the displacement is $f_0$, whereas the frequencies $f_1$ and $f_2$ correspond to the displacement values smaller than the peak value by 3 dB, respectively.

The loss factor [$\eta$] can be determined from the well known equation:

$$\eta=1/Q$$

where $Q=f_0/(f_2-f_1)$.

Therefore, the loss factor can be obtained by measuring $f_0$, $f_1$ and $f_2$.

Figure 6:
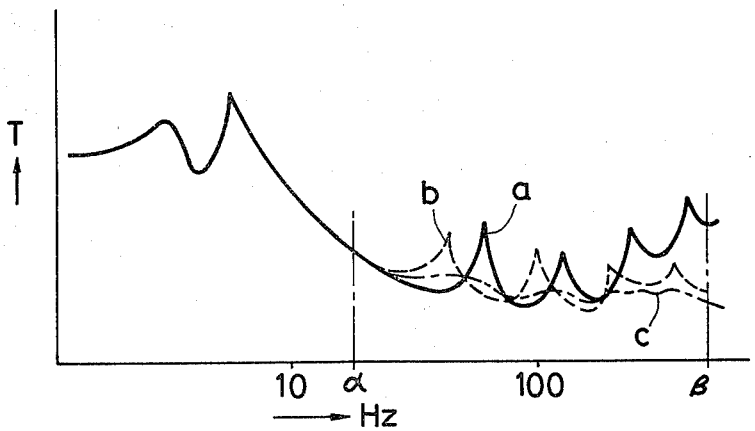
FIG. 6 is a graphical representation indicating the relation between vibration acceleration ratio vs frequency and a description of the vibration characteristic of the wire rope according to the present invention.

Referring now to FIG. 6 a graphical representation plotting frequency in Hz on the horizontal axis versus ratio of cage floor vibration acceleration to hoist torque, T defined by T=(cage floor vibration acceleration)/(hoist torque) on the vertical axis is shown. When the wire rope according to the present invention is used, the vibration characteristic curve of the class 1 wires 4 and 5 is as indicated by a in a frequency range of from $\alpha$Hz to $\beta$Hz, while the vibration characteristic curve of the class 2 wire 3 is as indicated by b in the same frequency range. Because of relative displacement of the class 2 wire 3 and the class 1 wires 4 and 5, the vibration characteristic curve of the wire rope shown in FIG. 2 is as indicated by c in FIG. 6, that is, rope surging is reduced.

Furthermore, it is desirable to use grease between the class 1 wires 4 and 5 and the class 2 wire 3. The influence of grease damping varies in proportion to the speed and friction due to local displacement of the wires 3, 4 and 5 are added each other, and according to the present invention, the undesired characteristics of rope surging can be eliminated to a considerable degree.

Since only the center wire 3 is a class 2 wire in the embodiment of FIG. 1, the mechanical properties such as tensile strength and bending fatigue of the wire rope are maintained, and yet the wire rope is relatively economical in terms of manufacturing costs and exhibits excellent vibration damping characteristics. These are also additional merits of the wire rope made according to the present invention.

In the embodiment shown in FIG. 1, the wire 3 is made of a chromium stainless steel material of class 2; however, it should be noted that the present invention is not limited to that choice of materials. Specifically, the wire 3 may be made of a titanium alloy material such as a titanium alloy comprising about titanium 90% and nickel 7%. In this case, the loss factor is equal to or more than 0.01, and therefore the same effect as the results for the wire rope shown in FIG. 6 can be obtained.

According to the experiments performed by the inventor, it has been found that if the difference in loss factor between the class 1 wire and the class 2 wire is of the order of 50%, rope surging is decreased.

In the above-described embodiment, a class 1 wire is employed for the wires 4 and 5 while a class 2 wire is employed for the wire 3. However, it is obvious that the choice of materials employed may be reversed to obtain the same effect as that of the rope wire shown in FIG. 6. They would be laid twisted as indicated in FIGS. 2 and 3, that is, the class 1 wires in contact with the class 2 wires.

Figure 7:
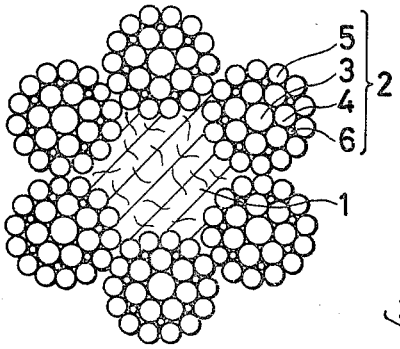
FIGS. 7 and 8 are cross-sectional views showing other type wire ropes made in accordance with the concept of the present invention.

The configuration of the wire rope shown in FIG. 1 is, as previously mentioned a type 15, Seal type 8 strands, of 19 wires each, with a fiber center core according to JIS rope classification (JIS G3525/1977). However, this invention is not limited to only this type of rope. That is, the technical concept of the invention can be applied to a Filler type rope as shown in FIG. 7. This is a type 13, Filler type 6 strands, of 29 wires each, with a fiber center core. Also, a Warrington type rope, shown in FIG. 8, may be used. This is a type 11, Warrington type 6 strands of 19 wires each, with fiber center core according to the JIS rope classification.

The other embodiments according to the present invention will be described with reference to FIGS. 7 through 12. It should be also noted that corresponding parts in FIGS. 7 through 12 have the same identifying reference numerals as in the prior examples.

FIG. 7 shows another embodiment of the wire rope according to the present invention. This wire rope is different from the one shown in FIG. 1 in that a plurality of intermediate layer wires 6 having a relatively small diameter are provided between the inner layer wires 4 and the outer layer wires 5. Also, the diameter of the inner layer wires 4 is larger than that in the first embodiment. In this wire rope, the center wire 3, the inner layer wires 4 and the outer layer wires 5 are made of the class 1 wires which are made of an ordinary steel material, while the intermediate layer wires 6 are made of the class 2 wires such as chromium stainless steel wires or titanium containing wires described. The class 2 wires vary from the class 1 wires in that the loss factor of the class 2 wires is at least 50% larger than that of the class 1 wires. In this case also, the same effect as described with reference to the graph of FIG. 6 can be obtained.

The wire rope shown in FIG. 7 may be modified so that the class 1 wires instead of the class 2 are employed for the intermediate layer wires 6, and the class 2 wire is employed for one of the center wires 3, inner layer wires 4 and outer layer wires 5. The same effect can be obtained with the wire rope so modified.

Figure 8:
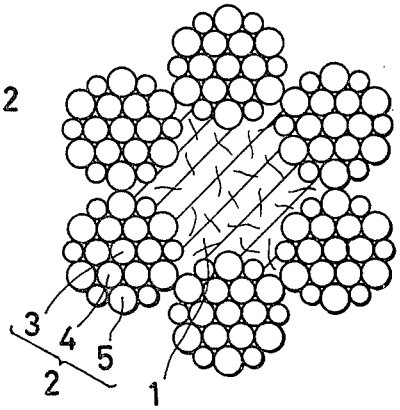

FIG. 8 shows a third embodiment of the wire rope according to the present invention. This wire rope is different from the first embodiment in that all of the wires which constitute strand 2, have nearly the same diameter. In strand 2 thereof, the wires which are employed for the wires 3, 4 and 5, have the same characteristics as those in the first embodiment. In this case, the same desirable effect as described with reference to FIG. 6 can also be obtained.

Figure 9:
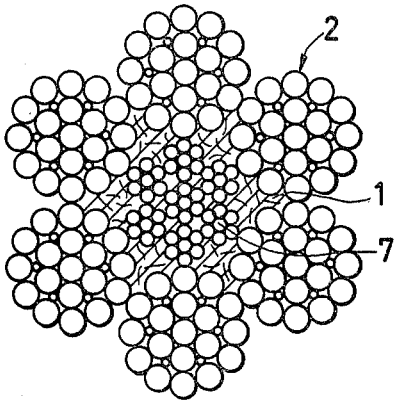
FIGS. 9 through 12 are also cross-sectional views illustrating additional examples of wire ropes made according to the present invention, respectively.

A fourth embodiment of the wire rope according to the invention is shown in FIG. 9. In this wire rope configuration, a strand 7 is inserted into the fiber center core 1 thereof. The strand 7 may be attained by twisting class 1 wires or class 2 wires as shown in FIG. 1. In either case, the same results as described with respect to the graph of FIG. 6 can be obtained.

Figure 10:
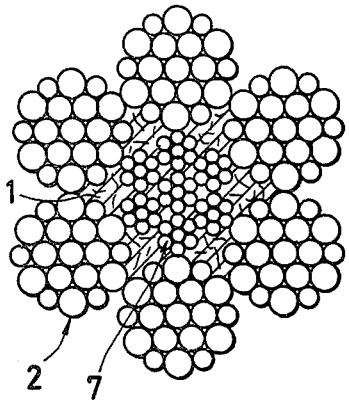

A fifth embodiment of the wire rope according to the present invention is illustrated in FIG. 10, in which a strand 7 is inserted into the fiber center core 1 in such a manner as to contact strands 2 that are laid around it. The class 1 wire is employed to form the strands 2, and the class 2 wire is used to form the central strand 7. In this embodiment also, the class 1 wires contact the class 2 wires, and the same effect as desired results as in the case of the other embodiments can be obtained.

Figure 11:
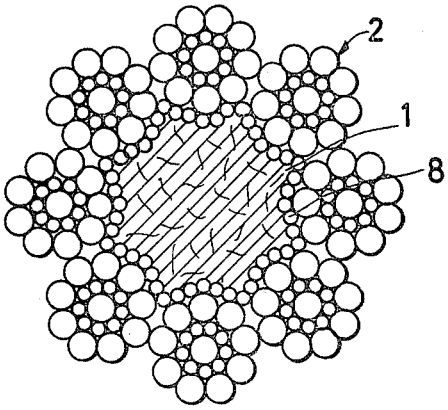

A sixth embodiment of the wire rope according to the present invention is shown in FIG. 11. In this wire rope configuration, the outer layer wires 8 made of class 2 wires are laid twisted around a fiber center core 1 made of non-metallic material such as hemp, and strands 2 made of class 1 wires are laid twisted around the outer layer wires 8. In the wire rope thus formed, the class 1 wires are in contact with the class 2 wires, and the same effect as described with reference to the FIG. 6 graph can be obtained.

Figure 12:
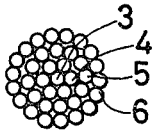

Finally a seventh embodiment of the wire rope according to the present invention is shown in FIG. 12. This wire rope type is a spiral wire rope. If each strand is formed with the class 1 and class 2 wires similarly as in the strand configuration 2 shown in FIG. 7, the same effect as described with reference to FIG. 6 can be obtained.

As is apparent from the above description, according to the present invention, the wire rope is formed with class 1 and class 2 wires which differ by at least 50% in loss factor from each other, in such a manner that they are in contact with one another. Therefore, when the wire rope is vibrated, the vibration characteristics of the class 1 wires and the class 2 wires interfere with each other to reduce rope surging in the high frequency range. Thus, problems caused by the transmission of rope surging to a structure suspended by the wire rope can be positively eliminated.

Variations and modifications of this invention are within its scope without departing from the essential aspect of forming the rope including wires having different loss factors.

What is claimed is:

1. A wire rope formed by twisting a first type of metal wire together with a second type of metal wire, said wire rope being of the Seal type of construction comprising a fiber center core and a plurality of strands wrapped about said core, each said strand having a center wire, an inner layer of wires and an outer layer of wires with at least one of said wires being of said first type and the other wires adjacent to said first type wire being of said second type, said wire rope further comprising a further strand inserted into said fiber center core to form a central strand, wherein said central strand is of the same type as said strands laid around said core, the loss factor of said first type of metal varying from the loss factor of said second type of metal by at least 50% whereby said wire rope damps vibrations that are induced therein.

2. A wire rope formed by twisting a first type of metal wire together with a second type of metal wire, said wire rope being of a Filler type of construction comprising a fiber center core and a plurality of strands wrapped about said core, each said strand having a center wire, an inner layer of wires, an intermediate layer of wires and an outer layer of wires with at least one of said wires being of said first type and the other wires adjacent to said first type wire being of said second type, said wire rope further comprising a further strand inserted into said fiber center core to form a central strand wherein said central strand is of the same type as said strands laid around said core, the loss factor of said first type of metal varying from the loss factor of said second type of metal by at least 50% whereby said wire rope damps vibrations that are induced therein.

3. A wire rope formed by twisting a first type of metal wire together with a second type of metal wire, said wire rope being of a Warrington type of construction comprising a fiber center core and a plurality of strands wrapped about said core, said strands having wires of substantially the same diameter and at least one of said wires being of said first type and the other wires adjacent to said first type wire being of said second type, said wire rope further comprising a further strand inserted into said fiber center core to form a central strand wherein said central strand is of the same type as said strands laid around said core, the loss factor of said first type of metal varying from the loss factor of said second type of metal by at least 50% whereby said wire rope damps vibrations that are induced therein.

4. A wire rope formed by twisting a first type of metal wire together with a second type of metal wire, said wire rope comprising a fiber center core, a strand inserted into said center core to form a central strand and a plurality of additional strands laid around said core, wherein said central strand is in contact with said additional strands laid around said core, said central strand being of said first type and said additional strands being of said second type, the loss factor of said first type of metal varying from the loss factor of said second type of metal by at least 50% whereby said wire rope damps vibrations that are induced therein.

5. A wire rope formed by twisting a first type of metal wire together with a second type of metal wire, said wire rope comprising a fiber center core, outer wires of said first type twisted about said center core and a plurality of strands of said second type twisted about said outer wires, wherein said outer wires are in contact with said strands, the loss factor of said first type of metal varying from the loss factor of said second type of metal by at least 50% whereby said wire rope damps vibrations that are induced therein.

6. The wire rope as defined in any one of claims 1–5 wherein said first type of metal is a chromium containing material.

7. The wire rope defined in claim 6 wherein said first type of material is a martensitic chromium stainless steel wire having a chemical composition comprising Cr 13% and Si 1%.

8. The wire rope as defined in any one of claims 1–5 wherein said first type of metal is a titanium alloy comprising about titanium 90% and nickel 7%.

* * * * *